US007146114B2

(12) United States Patent
Frankel et al.

(10) Patent No.: US 7,146,114 B2
(45) Date of Patent: Dec. 5, 2006

(54) SYSTEMS AND METHODS FOR END-OF-LIFE PREDICTION

(75) Inventors: Neil A. Frankel, Brighton, NY (US); Alberto Rodriguez, Webster, NY (US); Heiko Rommelmann, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 222 days.

(21) Appl. No.: 10/965,793

(22) Filed: Oct. 18, 2004

(65) Prior Publication Data

US 2006/0083522 A1 Apr. 20, 2006

(51) Int. Cl.
*G03G 15/00* (2006.01)
*G03G 21/00* (2006.01)

(52) U.S. Cl. ..... 399/27; 347/19; 358/1.14; 399/24; 399/111

(58) Field of Classification Search ..... 399/24, 399/25, 26, 27, 111, 110; 347/19, 86; 358/1.1, 358/1.14, 1.15
See application file for complete search history.

(56) References Cited

U.S. PATENT DOCUMENTS 5,272,503 A 12/1993 LeSueur et al. ..... 399/25
5,636,032 A 6/1997 Springett ..... 358/296
5,809,375 A 9/1998 Owens, Jr. et al. ..... 399/111
6,173,128 B1 1/2001 Saber et al. ..... 399/24
2003/0090696 A1* 5/2003 Willis et al. ..... 358/1.14
2004/0085565 A1* 5/2004 Owen et al. ..... 358/1.14
2004/0135838 A1* 7/2004 Owen et al. ..... 347/19

* cited by examiner

*Primary Examiner*—Sophia S. Chen
(74) *Attorney, Agent, or Firm*—Oliff & Berridge, PLC

(57) ABSTRACT

Determining an end-of-life prediction of a replaceable cartridge may be accomplished by analyzing input parameters independent of the cartridge, in addition to parameters of the cartridge. An event count denoting a consumption event is read from a memory in the replaceable cartridge. A current consumption status of the replaceable cartridge is determined based on an initial load and the event count of the replaceable cartridge. An input parameter is received from an input device regarding a next pending process that involves a pending consumption increment of the replaceable cartridge. A subsequent consumption status of the replaceable cartridge is determined corresponding to the current consumption status altered by the pending consumption increment. The subsequent consumption status is compared to a replacement condition to decide whether a replacement condition is satisfied. An alert indicator is signaled to an operator upon satisfaction of the replacement condition.

20 Claims, 2 Drawing Sheets

SYSTEMS AND METHODS FOR END-OF-LIFE PREDICTION

BACKGROUND OF THE INVENTION

1. Field of Invention

This invention relates to a method for predicting when a consumable unit should be replaced.

2. Description of Related Art

The photocopier industry modularizes a variety of consumable components as disposable cartridges, categorized by function, employed in the photocopier machine. Each of these cartridges to be inserted or removed from the machine constitutes a replaceable cartridge, designated in portions of the industry as a customer replaceable unit (CRU), for example, as described in U.S. Pat. No. 5,809,375 to Owens Jr. et al. and U.S. Pat. No. 6,173,128 to Saber et al. For example, a color photocopier may include a total of ten CRUs: four photoreceptor cartridges for each color separation cyan, magenta, yellow and black (CMYK) to be imaged, developed and transferred, four toner cartridges for each color to be developed, a second black toner cartridge, and a fuser cartridge for heating and fixing the image to the sheet.

An electronically erasable programmable read-only-memory (EEPROM) may be used to store identifier and status information for the CRU that is readable by a microprocessor in the machine. Integrated with the CRU, the EEPROM thus comprises a CRU monitor (CRUM), for example, as described in U.S. Pat. No. 5,272,503 to LeSueur et al. The CRUM provides identification to the microprocessor to enable verification that the model and configuration of the CRU is compatible and appropriate for use with the machine. This information can include pricing arrangements to distinguish CRUs intended for metered (flat-rate) contracts and pay-as-you-go orders, or regional designations to avoid arbitrage (use in an unintended market).

The CRUM also accumulates integer counts related to usage of the corresponding CRU. For each scanned image, for example, a photoreceptor CRU rotates its drum or belt for a design number of rotation cycles. Each cycle can be counted and accumulated in a photoreceptor CRUM. In another example, a printhead in a toner cartridge, ejects a quantity of ink (fluid) for each pixel. (Similarly, a xerographic device deposits a quantity of toner onto an electrostatically charged drum.) An ink (toner) CRUM counts and accumulates each ink ejection event by the printhead, for example, as described in U.S. Pat. No. 5,636,032 to Springett.

The photoreceptor can be operated for a design number of cycles before wear decreases reliability below an acceptable level, thus compromising print quality. When the number of cycles operated by the photoreceptor and counted by the photoreceptor CRUM exceeds a programmed threshold or end point, the microprocessor can signal the user that replacement is necessary. Similarly, a toner cartridge maintains a volume of toner material, which is consumed in the process of printing. When the number of print operations (or pixels) counted by the toner CRUM exceeds a threshold established for that toner model, the microprocessor can signal the user that the toner material in its reservoir is near depletion.

SUMMARY OF THE INVENTION

Establishing optimum thresholds that provide timely notice of the necessity of CRU replacement is important to avoid machine downtime. This requires accounting for a sufficient time period for delivery of a CRU product after being ordered, while permitting the almost complete consumption of the CRU to be replaced (or recharged). Counter accumulations of print count, for example, absent further processing, typically lack sufficient information for the microprocessor to optimize the thresholds. Data on print jobs in the queue may provide further information to be processed. Storing the geographic region where the machine is in use in the machine's non-volatile memory (NVM), and the time to deliver a replacement CRU by region in the CRU's CRUM, may provide further information to be processed.

After the original documents in a job to be printed have been scanned, or documents in a new print job are received from a network to which the printer is attached, the scanned or transmitted images can be analyzed to predict the number of photoreceptor cycles required and the number of pixels to be produced by the respective printheads to complete the corresponding print job in the queue. These are examples applicable to photoreceptor and toner CRUs. However, there are also other kinds of CRUs. In fuser CRUs, for example, the relevant measures might be the number of fuser roll or pressure roll cycles required, or the amount of fuser oil projected to be consumed, or the projected travel in mm of the cleaner/oiler web.

If, prior to processing the print job, the projected usage yields a predicted count value that exceeds a corresponding threshold, the user can be notified that job completion may require additional supplies. Such notice avoids interruption of a print job in mid-process, and facilitates consideration of alternate options (by manual input or automatic response), such as a reordered sequence of other jobs in the queue that can be processed without exhausting available supplies in the currently installed CRUs.

Various processes and algorithms in the form of methods, storage media and/or devices may be provided that determine an end-of-life prediction of a replaceable cartridge. This development may be accomplished, for example, by engaging the following operations. An event count may be read from a memory in the replaceable cartridge, the event count denoting a consumption event of the replaceable cartridge. A current consumption status of the replaceable cartridge may be determined, with the current consumption status based on an initial load and the event count of the replaceable cartridge.

An input parameter may be received from an input device or from a network regarding a next pending process that involves a pending consumption increment of the replaceable cartridge. A subsequent consumption status of the replaceable cartridge may be determined, the subsequent consumption status corresponding to the current consumption status altered by the pending consumption increment. The subsequent consumption status may be compared to a replacement condition to decide whether a replacement condition is satisfied. An alert indicator may be signaled to an operator upon satisfaction of the replacement condition. A print may be generated to provide the customer with reorder instructions and/or purchase order documents.

In various exemplary implementations, a signal may be provided to enable a shift in the order of the pending jobs in the queue. Alternatively, the signal can alert the operator of the replacement condition.

BRIEF DESCRIPTION OF THE DRAWINGS

Various details of this invention are described below with reference to the following figures, wherein.

DETAILED DESCRIPTION

The following detailed description refers to a replaceable cartridge, for example, in a document processing system. The replaceable cartridge, may refer to, for example, an ink reservoir CRU and a photoreceptor drum CRU, etc., for sake of clarity and familiarity. However, it should be appreciated that the principles described herein, can be equally applied to any known or later-developed replaceable cartridges, beyond the CRUs specifically discussed herein.

For example, data independent of the replaceable cartridge, such as, from a scanned image, or other document reproduction input, including information from past or anticipated future jobs, can be used to augment prediction of when CRU refurbishment may be necessary. An algorithm can be used to determine future demand on the CRU prior to execution of the job, thereby alerting the user that rescheduling of pending jobs and/or reorder of supplies may soon be required.

Figure 1:
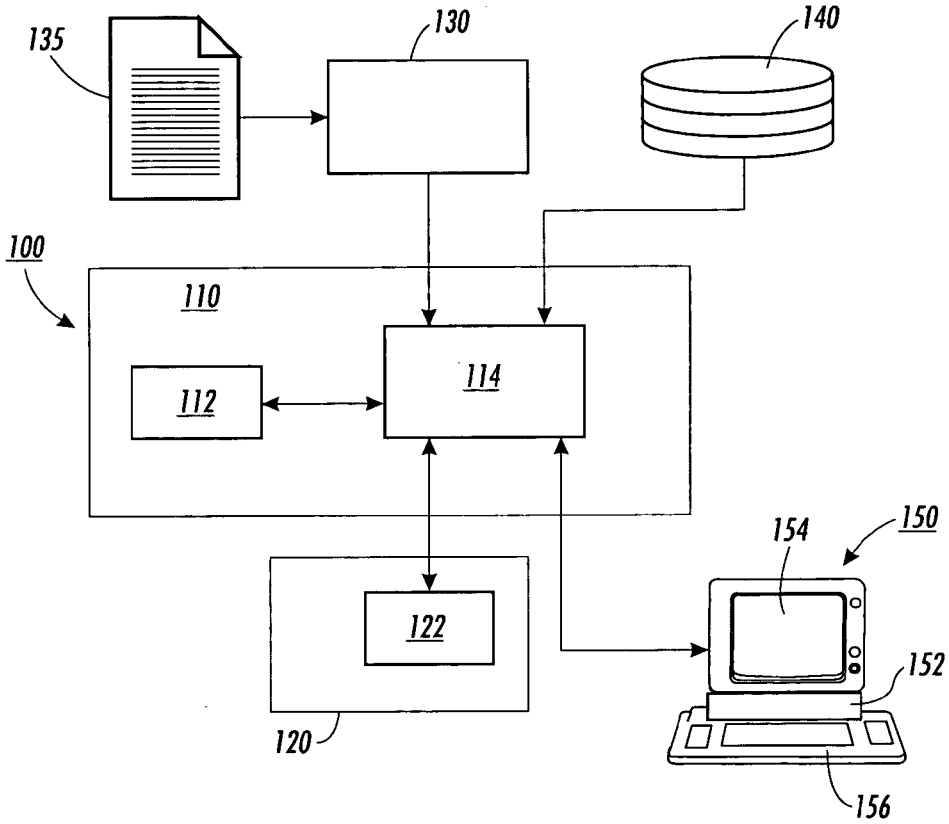
FIG. 1 shows an exemplary block diagram of a document processing system.

FIG. 1 shows an exemplary block diagram of the system 100. A machine assembly 110 for the system 100 includes a machine NVM 112 and a processor or central processing unit (CPU) 114. A replaceable cartridge 120 associated with the machine assembly 110 includes a cartridge CRUM 122. The CPU 114 reads and writes to the machine NVM 112 and the cartridge CRUM 122.

The system 100 may also include a scanner 130 for processing a document 135. The scanner 130 provides information regarding scanned parameters of the document 135 to the CPU 114. A database 140 may provide additional stored information, such as customer schedule and inventory data, for example. A workstation or terminal 150 can also communicate with the CPU 114 via a terminal processor 152. A screen monitor 154 may be used to provide a display medium for visual or audio information to be presented to the user by the CPU 114. An input device 156, such as a keyboard, mouse, keypad or other user interface device may be used to provide instruction or selection data to the CPU 114.

Figure 2:
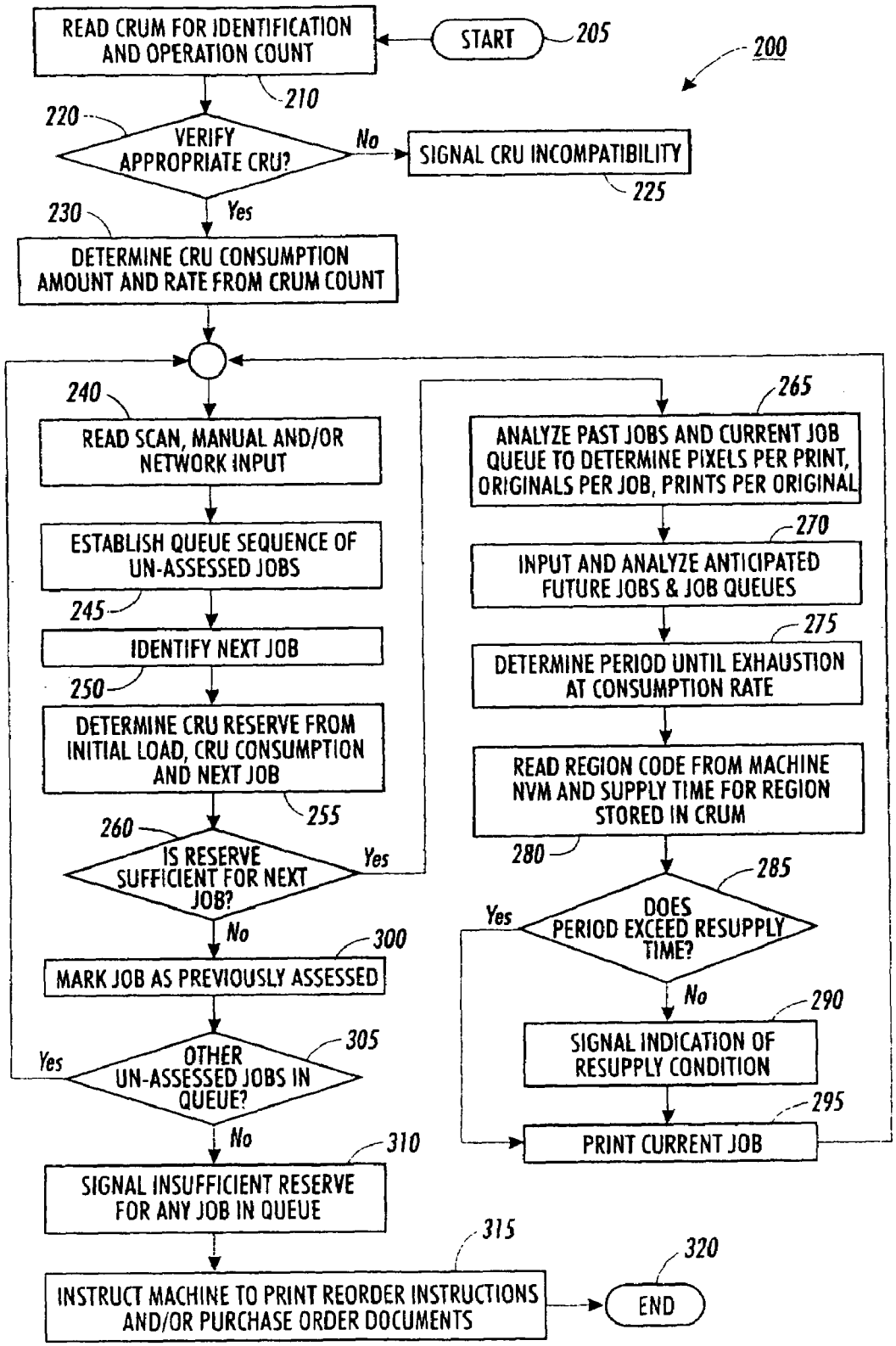
FIG. 2 shows an exemplary flowchart for an end-of-life prediction.

FIG. 2 shows an exemplary flowchart 200 of a method for predicting end-of-life of a consumable unit, for example, in a document processing system. The method begins at a start 205 and proceeds to read, for example, a cartridge CRUM at step 210 for identification and operation count information. A first query is performed at step 220 to verify the appropriate cartridge or CRU. If the cartridge is not appropriate, a signal is dispatched at step 225 to, for example, a monitor to indicate incompatibility with the installed cartridge.

Otherwise, the process continues to step 230 where a consumption quantity and a rate of consumption of the cartridge are determined based on a count value from the cartridge CRUM. The process continues to step 240 in which the information on new jobs to be added to the queue is provided from, for example, a scanner that reads a document or documents, a network to which the machine is connected, or from manual instructions through, for example, an input device.

The process continues to step 24 where the sequence of un-assessed jobs in the queue is determined using an algorithm. Assessed jobs are those jobs that have previously been determined to be too large to complete given the present CRU reserve. Useful algorithms include (1) sequence via arrival time, (2) sequence via the CRU reserve in relation to the reserve requirement, (3) sequence via priority assigned, and (4) sequence via some combination of(1), (2) and (3). For each job, the reserve margin for each CRU maybe defined as the reserve margin for each CRU being the difference between the actual reserve and the reserve required. For systems with two or more CRUs, algorithm (2) may be preferred to sequence the jobs in the queue based on the magnitude of the smallest (or most negative) reserve margin.

The process continues to step 250 where the next job is identified as the first in the queue. The process continues to step 255 to determine a remaining cartridge reserve (prior to replacement or refurbishment being needed). The reserve is determined based on the initial provision or load, and the cartridge consumption over the relevant period.

A second query is performed at step 260 to determine whether the reserve is sufficient for the next job in the queue. If the query response is affirmative, the process continues to step 265 for analysis of past jobs and jobs in the current queue, determining pixels per print, original documents per job, and prints per original document, along with an estimate of the corresponding consumption rate.

The process continues to step 27O to allow for input and analysis of anticipated future jobs and job queues, for which the same determinations are made. The process continues to step 275 to determine the period until the cartridge is exhausted at the determined and anticipated consumption rate. The process continues to step 280 to read the geographical region code from the machine NVM and the CRU resupply time for the region stored in the CRUM.

The process continues to a third query is performed at step 285 to determine whether the period until exhaustion exceeds the indicated resupply interval after an order is placed. If the answer is negative, the process continues to step 290 where an indication is signaled that a resupply or replacement contingency must be addressed, and then the process continues to step 295 where the current job is completed, and returns to step 240. Otherwise, the process skips to step 295 to complete current job, and then the process returns to step 240.

If the query response at step 260 is negative the process continues to step 300, and the job is marked as previously assessed. The process enters another query at step 305 regarding additional un-assessed jobs after the current job in the queue. If no further un-assessed jobs are scheduled, the process continues to step 310 and a signal is dispatched that there is insufficient reserve for completion of the next job. If the queue contains additional un-assessed jobs after the current job, process returns to step 240

Thus, the process enables expected consumption of the replaceable cartridge to be predicted, based not only on event counts recorded in the CRUM, but also on input data from other devices, for example, the scanner and/or the input device and/or the network providing input at step 240. The inputs can be used to build the job queue which is ordered at step 245 to identify the next job at step 250 and thereby determine if the CRU reserve is sufficient for the next job at step 255 and to signal insufficient reserves for any job in the queue at step 310 The process continues to step 315 where the machine is instructed to print reorder instructions and/or purchase order documents, leading to termination at step 320.

While various details have been described in conjunction with exemplary implementations outlined above, many alternatives, modifications and variations are possible. Accordingly, the exemplary implementations set forth above are intended to be illustrative, not limiting.

What is claimed is:

1. A method for determining an end-of-life prediction of a replaceable cartridge, comprising:

reading an event count from a memory in the replaceable cartridge, the event count denoting a consumption event of the replaceable cartridge;

determining a current consumption status of the replaceable cartridge, the current consumption status being based on an initial load and the event count of the replaceable cartridge;

receiving an input parameter from an input device regarding a next pending process that involves a pending consumption increment of the replaceable cartridge; and determining a subsequent consumption status of the replaceable cartridge, the subsequent consumption status corresponding to the current consumption status and the pending consumption inecrement;

comparing the subsequent consumption status to a replacement condition to determine whether a replacement condition is satisfied; and signaling an alert indicator upon the replacement condition being satisfied, wherein comparing the subsequent consumption status to a replacement condition to determine whether a replacement condition is satisfied comprises determining a consumption rate of the replaceable cartridge based on a change in the event count and a change interval between successive event counts.

2. The method according to claim 1, wherein receiving an input parameter from an input device comprises receiving an input parameter from a scanner.

3. The method according to claim 1, wherein receiving an input parameter from an input device comprises receiving an input parameter from a manual interface device.

4. The method according to claim 1, wherein determining a subsequent consumption status further comprises:

determining a future consumption event based on the input parameter; and determining the subsequent consumption status based on the current consumption status and the future consumption event.

5. The method according to claim 4, wherein determining a future consumption event comprises receiving a plurality of future jobs yet to be processed.

6. The method according to claim 1, wherein comparing the subsequent consumption status to a replacement condition to determine whether a replacement condition is satisfied further comprises:

determining a replacement condition threshold between an exhaustion condition and a resupply delivery interval multiplied by a consumption rate for the replaceable cartridge; and determining whether the subsequent consumption status based on the current consumption status and the pending consumption increment corresponds to the replacement condition threshold.

7. The method according to claim 1, wherein signaling an alert indicator comprises:

transmitting a signal that the replaceable cartridge is ready for disposal.

8. The method according to claim 1 wherein signaling an alert indicator comprises:

determining a plurality of pending processes in a queue, wherein the next pending process is an immediate successor to a previous completed process; and sequencing a subsequent pending process in the queue in precedence of the next pending process.

9. A machine-readable storage medium having executable software code for determining an end-of-life prediction of a replaceable cartridge, the software code comprising:

instructions for reading an event count from a memory in the replaceable cartridge, the event count denoting a consumption event of the replaceable cartridge;

instructions for determining a current consumption status of the replaceable cartridge, the current consumption status based on an initial load and the event count of the replaceable cartridge;

instructions for receiving an input parameter from an input device regarding a next pending process that involves a pending consumption increment of the replaceable cartridge; and instructions for determining a subsequent consumption status of the replaceable cartridge, the subsequent consumption status corresponding to the current consumption status altered by the pending consumption increment;

instructions for comparing the subsequent consumption status to a replacement condition to determine whether a replacement condition is satisfied; and instructions for signaling an alert indicator upon the replacement condition being satisfied, wherein comparing the subsequent consumption status to a replacement condition to determine whether a replacement condition is satisfied comprises instructions for determining a consumption rate of the replaceable cartridge based on a change in the event count and a change interval between first and second event counts.

10. The machine-readable storage medium according to claim 9, wherein receiving an input parameter from an input device comprises receiving an input parameter from a scanner.

11. The machine-readable storage medium according to claim 9, wherein receiving an input parameter from an input device comprises receiving an input parameter from a manual interface device.

12. The machine-readable storage medium according to claim 9, wherein determining a subsequent consumption status further comprises:

instructions for determining a future consumption event based on the input parameter; and instructions for determining the subsequent consumption status based on the current consumption status and the future consumption event.

13. The machine-readable storage medium according to claim 12, wherein instructions for determining a future consumption event comprises instructions for receiving a plurality of future jobs yet to be processed.

14. The machine-readable storage medium according to claim 9, wherein comparing the subsequent consumption status to a replacement condition to determine whether a replacement condition is satisfied further comprises:

instructions for determining a reserve basis based on an exhaustion condition and a resupply delivery interval multiplied by a consumption rate to serve as a replacement condition threshold for the replaceable cartridge; and instructions for determining whether the subsequent consumption status based on the current consumption status and the pending consumption increment corresponds to the replacement condition threshold.

15. The machine-readable storage medium according to claim 9 wherein signaling an alert indicator comprises:

transmitting a signal to a receiver that the replaceable cartridge is ready for disposal.

16. The machine-readable storage medium according to claim 9 wherein instructions for signaling an alert indicator comprises:

instructions for determining a plurality of pending processes in a queue, wherein the next pending process is an immediate successor to a previous completed process; and instructions for sequencing a subsequent pending process in the queue in precedence of the next pending process.

17. An apparatus for determining an end-of-life prediction of a replaceable cartridge, comprising:

a reader that reads an event count from a memory in the replaceable cartridge, the event count denoting a consumption event of the replaceable cartridge;

a current status determiner that determines a current consumption status of the replaceable cartridge, the current consumption status based on an initial load and the event count of the replaceable cartridge;

a receiver that receives an input parameter from an input device regarding a next pending process that involves a pending consumption increment of the replaceable cartridge;

a pending status determiner that determines a subsequent consumption status of the replaceable cartridge, the subsequent consumption status corresponding to the current consumption status altered by the pending consumption increment:

a comparator that compares the subsequent consumption status to a replacement condition to determine whether a replacement condition is satisfied; and a signaler that signals an alert indicator upon the replacement condition being satisfied, wherein the comparator comprises a consumption rate determiner that determines a consumption rate of the replaceable cartridge based on a change in the event count and a change interval between first and second event counts.

18. The apparatus according to claim 17, wherein the comparator further comprises:

a reserve determiner that determines a reserve basis between based on an exhaustion condition and a resupply delivery interval multiplied by a consumption rate to serve as a replacement condition threshold for the replaceable cartridge; and a threshold comparator that determines whether the subsequent consumption status based on the current consumption status and the pending consumption increment corresponds to the replacement condition threshold.

19. The apparatus according to claim 17, wherein the current status determiner further comprises:

a future consumption determiner that determines a future consumption event based on the input parameter; and a subsequent status determiner that determines the subsequent consumption status based on the current consumption status and the future consumption event.

20. The apparatus according to claim 17, wherein the signaler comprises:

a pending process sequence determiner that determines a plurality of pending processes in a queue, wherein the next pending process is an immediate successor to a previous completed process;

a sequence shifter that sequences a subsequent pending process in the queue in precedence of the next pending process.

* * * * *